United States Patent [19]

Carlson et al.

[11] Patent Number: 4,542,676

[45] Date of Patent: Sep. 24, 1985

[54] ORNAMENT ASSEMBLY

[75] Inventors: Ronald L. Carlson, Riverside, Mo.; Edward G. Seale, Prairie Village, Kans.

[73] Assignee: Hallmark Cards, Inc., Mo.

[21] Appl. No.: 386,390

[22] Filed: Jun. 8, 1982

[51] Int. Cl.[4] ..... G10F 1/06; A47G 33/08

[52] U.S. Cl. ..... 84/94 C; 428/11

[58] Field of Search ..... 84/94-95; 206/497; 215/12 R, 321; 428/7, 11

[56] References Cited

U.S. PATENT DOCUMENTS

| | | | |
|---|---|---|---|
| 2,726,320 | 12/1955 | Damiano | 428/11 |
| 3,083,854 | 4/1963 | Lusher | 215/12 |
| 3,635,783 | 1/1972 | Rimmler | 428/11 |
| 3,829,348 | 8/1974 | Spiegel et al. | 428/11 |
| 4,173,667 | 11/1979 | Rusch | 428/11 |

FOREIGN PATENT DOCUMENTS

| | | | |
|---|---|---|---|
| 990505 | 4/1965 | United Kingdom | 428/11 |

*Primary Examiner*—Lawrence R. Franklin

*Attorney, Agent, or Firm*—Neuman, Williams, Anderson & Olson

[57] ABSTRACT

A multi-purpose ornament assembly is disclosed which includes a plurality of separate interchangeable elements, including a lightweight plastic main body surrounded by a shrink-wrapped decorative film and a pair of upper and lower end caps which frame the main body. In its preferred form the invention includes a spring powered music generator which is enclosed by the main body and the upper end cap. The winding element for the music generator is coupled to the hook or eyelet at the top of the ornament from which the ornament is suspended. Rotary motion of the hook or eyelet relative to the top of the ornament winds the music generator and causes the suspended ornament to thereafter rotate on its vertical axis as the spring motor of the generator unwinds. Alternative embodiments include a musical ornament which serves the additional function of being a gift box for small objects such as jewelry or the like.

2 Claims, 8 Drawing Figures

ORNAMENT ASSEMBLY

BACKGROUND AND BRIEF DESCRIPTION OF THE INVENTION

This invention relates generally to holiday ornaments and, in particular, to ornamental enclosures having multiple functions.

In recent years suspended ornaments for Christmas and other occasions have become increasingly ornamental, complex and expensive. One popular method for making Christmas ornaments has included the steps of imprinting a decorative scene or floral pattern on a heat-shrinkable film, and then heat-shrinking the film onto a spherical ball of glass, plastic or the like. While ornaments made with this method are quite attractive, conventional shrink-wrap techniques impose some restraints on the process and create some undesirable visual effects. Generally, the processing equipment requires that the shrink-wrap material be imprinted with a pattern over less than its complete surface. The unprinted edge portions may be smokey in color and irregular in shape, creating an undesirable visual effect.

It is one of the objects of the present invention, therefore, to provide a decorative ornament which consists of a plurality of overlapping parts which serve to mask the visually undesirable portions of the shrinkwrap material on ornaments made with the foregoing process.

To further enhance the desirability and functionality of decorative ornaments, a spring driven music transducer element or generator has been incorporated into the design of the aforesaid multi-part decorative ornament. While small mechanical music generators have been used in music boxes, toys, picture albums, jewelry boxes and many other applications, the incorporation of such a generator in a suspended holiday ornament provides an unexpected degree of appeal, since the use of the musical element in the manner taught in the present invention creates a rotation of the ornament around its vertical axis. This allows the entire scene imprinted on the ornament to be displayed with musical accompaniment as an added benefit.

The incorporation of a musical generator into a holiday ornament is implemented in the present instance through the provision of a multi-part ornament construction which incorporates lightweight injection molded plastic parts, thus making it possible to create an overall structure which is light enough to be suspended from a tree or the like in the same manner as other ornaments. The assembly includes a main body of plastic made through an injection blow molding process and a pair of end caps which intermate with the main body in a snap fit. The small lightweight music generator is mounted on a plastic sound board which is enclosed between the main body and one of its plastic end caps, the winding shaft for the music box extending through the top of the upper end cap to form an engageable hook or eyelet for suspension of the ornament from above. A resilient latching feature is incorporated into the interlocking edges of the main body and the end caps. This latching construction combines with the inherent resilience of the injection molded plastic parts to provide generous dimensional tolerances that allow the manufacturer to provide the same element with or without the addition of a music generator and sounding board.

As a further object and advantage of the present invention an ornament is provided which has a plurality of lightweight, inexpensive and interchangeable parts so that a variety of ornamental configurations can be achieved with a minimum number of plastic injection molds. The versatility of the system for making multiple decorative patterns is, of course, enhanced through the use of shrink-wrap decorative films about the periphery of the ornament. While this has been done in the past on single piece ornaments, as noted above, the use of separable end caps with extended flanges in the present invention serves to cover the undesirable portions of the imprinted shrink-wrap material and enhance the overall appearance of the ornament.

Still a further object of the present invention is the provision of an ornament assembly which has a plurality of alternate physical configurations. By elimination of the bottom end cap the assembly may be used as a freestanding ornament for a shelf, mantel or the like and/or as a freestanding music box. Even greater versatility is achieved through use of the ornament as a gift container. As such, one embodiment of the invention employs releaseable latching elements on the mating edges of the main body portion and the top cap, allowing the ornament to be used as a container and to be opened and closed in the same manner as would a gift box. Once the gift is received and taken from the container, the container is reassembled and readily suspended or left freestanding as a musical ornament. Thereafter it may be used as an ornament every year as a reminder of the gift originally given.

Other objects and advantages of the invention will become apparent upon reading the following detailed description and the appended claims and upon reference to the accompanying drawings.

While the invention will be described in connection with certain preferred embodiments, it will be understood that it is not intended that the invention be limited to those embodiments. On the contrary, the invention is intended to include all alternatives, modifications and equivalents as may be included within the spirit and scope of the disclosure and the appended claims.

DESCRIPTION OF THE PREFERRED EMBODIMENTS

Figure 1:
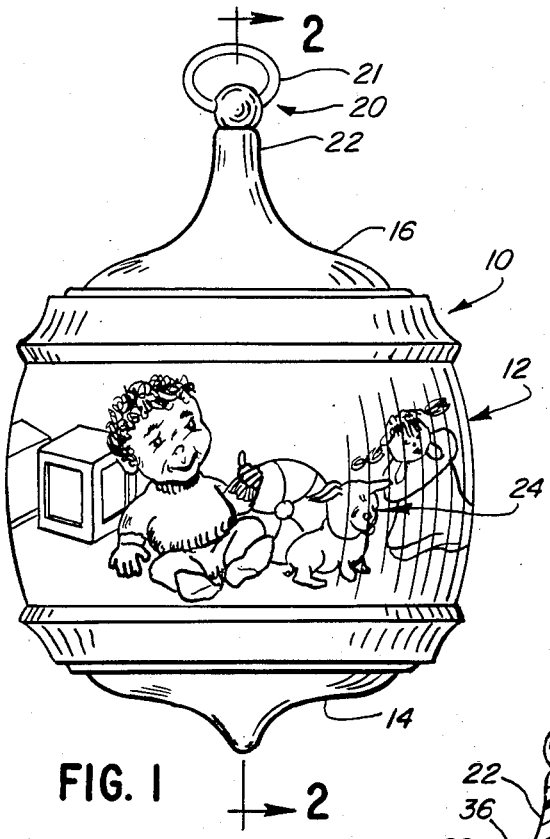
FIG. 1 is a side elevational view of the ornament assembly of the present invention fully assembled.

Turing now to the drawings, FIG. 1 depicts a suspendable ornament 10 having a main body portion 12, a bottom end cap 14, and a top end cap 16. An engageable hook or eyelet element 20 extends from a protruding conical section 22 formed in the top end cap 16 and provides a convenient means for suspending the ornament from above by a Christmas tree hook, a wire stand or the like.

Figure 2:
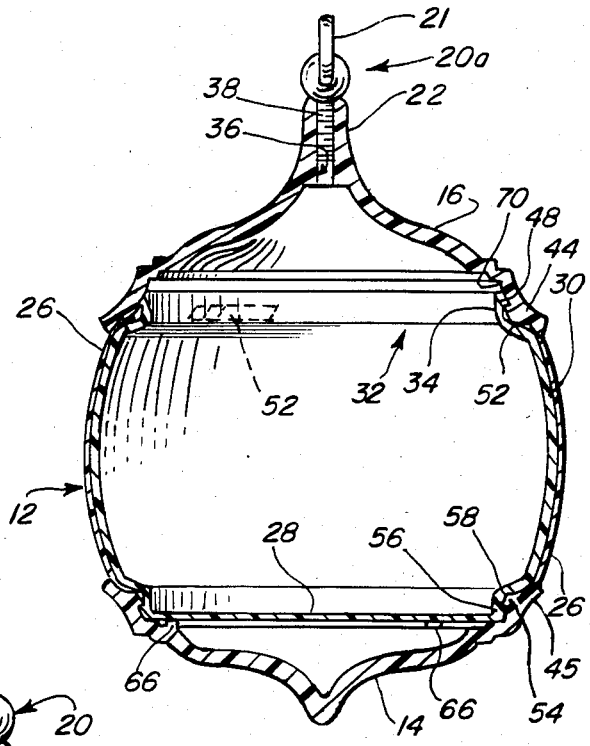
FIG. 2 is a side view similar to FIG. 1 partially cut away to reveal the interior construction without the additional music generator.
Figure 4:
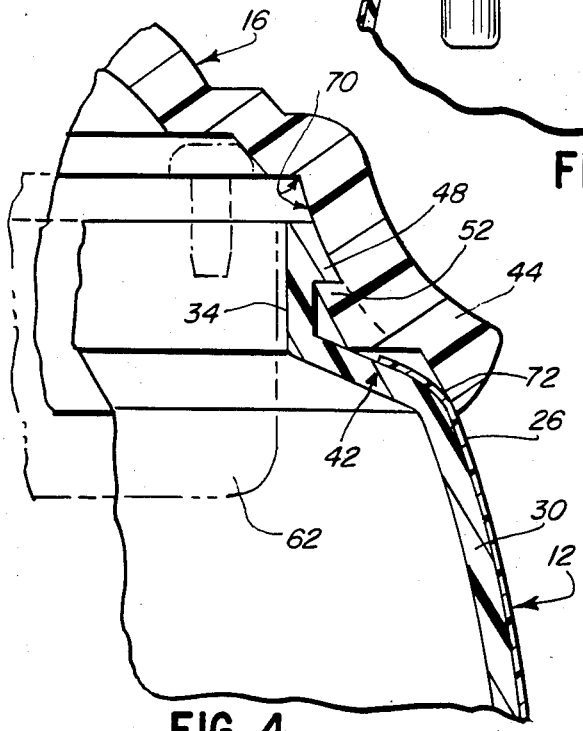
FIG. 4 is an enlarged cross-sectional view of the interlocking flange area of the ornaments shown in FIGS. 1–3.

The principal decorative indicia for the ornament is contained on the main body element 12 and is shown generally at 24. While this indicia would appear to be imprinted on the main body portion itself, it is one of the features of the present invention that this indicia is applied to the ornament through a far less expensive and more versatile procedure. More specifically, the main body portion 12 is surrounded by a decoratively printed film or band 26 of heat-shrinkable PVC or like material which is applied through a shrink-wrap process. For a better understanding of the interrelationship of the various parts of the ornament, reference is made more specifically to FIG. 2, where the ornament is shown in cut-away view without the optional sound board to be described below. As shown therein, the main body 12 is a unitary plastic part having a closed bottom 28 and sides 30 forming a hollow cylindrical cavity. The main body 12 is preferably made of a modified impact styrene called DYLARK 240 manufactured by ARCO Corporation. This material lends itself well to injection blow molding, while at the same time being sufficiently temperature stable to withstand the elevated temperature to which it is subjected during heat-shrinking of the decorative film 26. The main body has an upper opening 32 which is rimmed by a lip structure 34 shown in greater detail in FIG. 4.

The bottom end cap 14 is also preferably constructed of impact styrene plastic that is formed through the injection molding technique. For the embodiments in which a bottom cap is used, the cap is secured to the main body portion 12 through a flexible snap fit arrangement described more fully below.

The top element 16 is similarly formed of impact styrene plastic through the injection molding process. The protruding neck portion 22 has a vertically extending channel 36 formed therein which accepts the threaded shank 38 of the engageable hanger element 20*a* (FIG. 2) or the vertically extending stem or shaft 40 of a winding element for the sound-enhanced embodiment shown in FIG. 3.

As noted above, the top and bottom end caps 14 and 16 are not only decorative in themselves, but they have aprons which serve to cover the often unsightly edges of the shrink-wrap material 26 extending around the upper and lower portions of the sidewall 30 of the main body element 12. As shown more graphically in the enlarged view of FIG. 4, the imprinted film 26 extends around the upper shoulder of the sidewall 30 to a point designated generally with the numeral 42. To cover this extended edge of the shrink-wrap film 26 the top and bottom caps have extended apron portions 44, 45, respectively, which extend beyond the shoulder area of the sidewall 30 into overlapping engagement with the edges of the shrink film 26.

Figure 8:
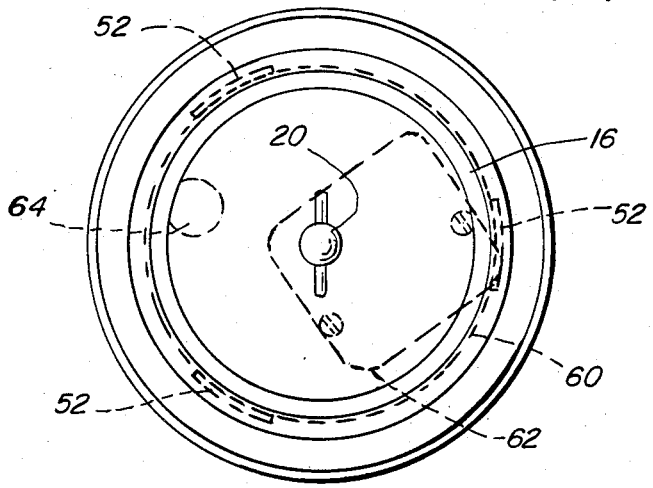
FIG. 8 is a plan view of the top cap and sounding board mechanism of the present invention.

To secure the upper end cap 16 to the main body 12, an outwardly extending flange 48 is provided around the lip 34 surrounding the opening 32 on the main body element 12. The flange 48 interlocks with an inwardly projecting flange or shoulder 52 formed on the inside of the upper end cap 16. The flange 52 is preferably discontinuous around the periphery of the end cap 16 and is typically formed in only three short sectors to define gripping "fingers" around the circumference of the end cap 16 (shown in FIGS. 2 and 8). This facilitates the flexing of both the end cap and the lip 49 in the regions between the finger sections 52 around the periphery of the opening and allows a tight fit to be achieved with very generous manufacturing tolerances. Similarly spaced flange elements or fingers 54 are provided on the bottom end cap 14. These cooperate with a continuous flange element 56 which is formed around the periphery of the bottom edge of the main body and which serves to define a groove 58 which accepts the flange elements or fingers 54. It will be appreciated, of course, that the locations of the fingers 54 and flange area 56 could be reversed, i.e., the flange area 56 could be discontinuous along the lip of the main body 12 and a continuous flange provided on the inside of the end cap 14.

Figure 3:
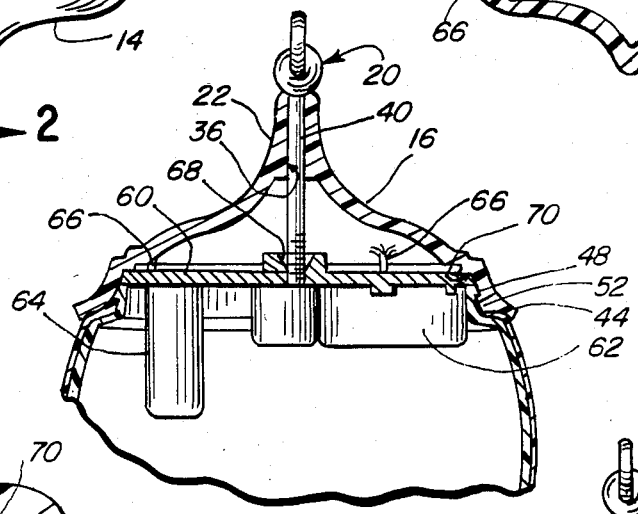
FIG. 3 is a sectional view similar to FIG. 2 depicting an ornament in which the music generator is included.

In the preferred embodiment of the present invention the assembly thus far described is provided with a musical sound board to create an ornament which appeals not only to the visual but to the aural senses. Turning more specifically to FIG. 3, there is shown a horizontally disposed sound board 60 of generally circular configuration which is sandwiched between the upper end cap 16 and the main body element 12. Mounted to the sound board 60 is a spring-driven mechanically actuated music generator 62 which is wound via the shaft or stem 40 from the hanger element or eyelet assembly 20 on the outside of the ornament. In this way the element 20 acts both as a hanger for suspension of the ornament and as a convenient winder element for manually energizing the generator 62. After winding, the stem 40 and winder 20 act as a stationary pivot about which the ornament rotates while playing its song.

The sound generator or transducer element 62 may be any of a plurality of standard miniature sound boxes. One such box is designated by Stock No. 12M-S301 and manufactured by Sankyo Corporation. The song to be played is pre-programmed into the mechanical assembly and is typically a Christmas carol if the ornament is to be used for the Christmas holiday.

To offset the weight of the music generator 62 and to thereby provide for level vertical hanging of the ornament, a counterweight 64 is provided diametrically opposite the generator 62 on the sound board 60. The counterweight 64 and the transducer element 62 may be mounted to the board 60 by suitable fastening means such as screws, rivets, glue or the like. Alternatively, the counterweight and/or music generator may be fitted with portions that press fit into the sound board for secure retention without additional fasteners.

The sound board 60 is typically formed of ABS or styrene plastic. To keep it from rotating as it nests between the main body 12 and end cap 16, the sound board is molded with roughened edges along its periphery. To further secure the sound board 60 and prevent rotation, the end cap 16 has formed on its inside surface several projecting posts 66 that extend downward into engagement with the upper surface of the sound board 60. As still a further feature of its construction, the sounding board 60 has a conically-shaped well 68 at its center to define a tapered lead-in area for receiving the stem 40 of the winder assembly 20. The conical shape of the well 68 allows the assembler to guide the stem into position for screw-type engagement with the internal mechanism of the music generator 62.

To illustrate yet another feature of the construction used in the present invention, reference is again made to FIG. 4, where it is seen that the interlocking flange elements joining the end cap 16 to the main body 12 are adapted to function equally well with or without the presence of the sound board 60. The sound board 60 nestles into a recess 70 defined by the top of the flange element 48 and an inside surface of the end cap 16. The sound board 60 is sized so as to be compressed within this space in the preferred embodiment. However, in the absence of the sound board 60, the connection between the end cap 16 and the body 12 remains secure due to the fact that the extended apron portion 44 of the cap 16 has an inside surface 72 that abuts the sidewall 30 of the main body 12 to prevent relative movement between the two elements whenever the fingers 52 of the end cap 16 engage the flange area 48 of the main body.

From the foregoing it should be apparent that the construction of the present invention may be manufactured quite economically. A single mold can be used for making the main body elements 12 for a wide variety of different ornaments, since the decorative appearance is provided by the shrink-wrap outer film 26 which is heat-shrunk to the body 12. Similarly, the end caps 14 and 16 can be molded in an infinite variety of colors to coordinate with the various scenes of patterns used on the decorative film 26 or the main body. Of course, all of these color combinations can be achieved with a minimum number of molds for the end caps 14 and 16. Also, as noted above, the channel 36 for the top cap 16 can accommodate a screw-in hook or eyelet device (FIG. 2) or a winder stem for a music generator (FIG. 3). The winder assembly 20 and its stem 40 are preferably made in a screw machine as a unitary item with only the eyelet loop 21 added before final assembly. The lower end of the stem 40 of the winder assembly is threaded to mate with the internal mechanism of the sound generator 62 in a manner well-known in the art.

Figure 5:
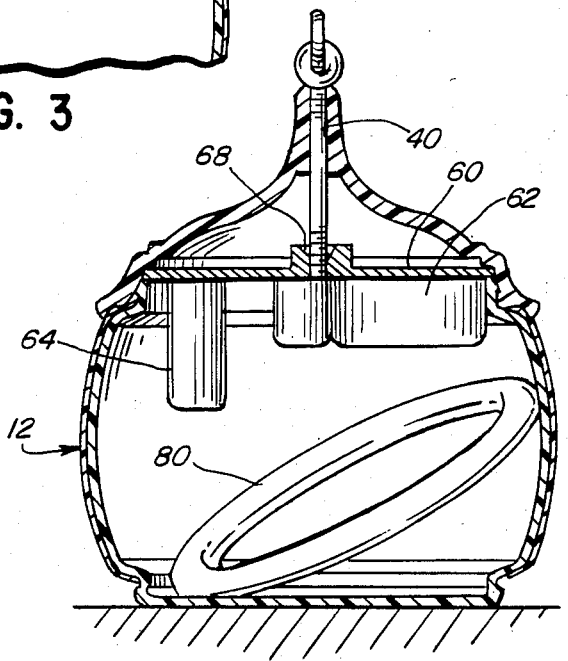
FIG. 5 is a sectional side view of the ornament assembly depicting its use as a gift container.

In accordance with another aspect of the present invention, the ornament structure may be adapted for use as an ornamental gift box which serves the dual purposes of housing a gift and thereafter acting as a musical remembrance of the gift when used repeatedly through the years as an ornament. An adaptation of the ornament for this use is shown in FIG. 5, wherein the main body element 12 is shown with a gift 80, such as a ring, a bracelet or the like within the housing. Used as a gift box the ornament structure may or may not include the sound board 60. If a generator is to be included, the sound board 60 is preferably glued or secured by other means within the inside of the cap 16 so that it may be retained by the cap 16 when the cap is removed from the container. To facilitate the use of the ornament as a gift box, the bottom cap 14 is either removed to expose the flat bottom surface of the main body element 12 or the entire assembly is provided with an additional plastic spacer ring (not shown) in which the bottom cap 14 may nest for display on a flat surface.

Figure 6:
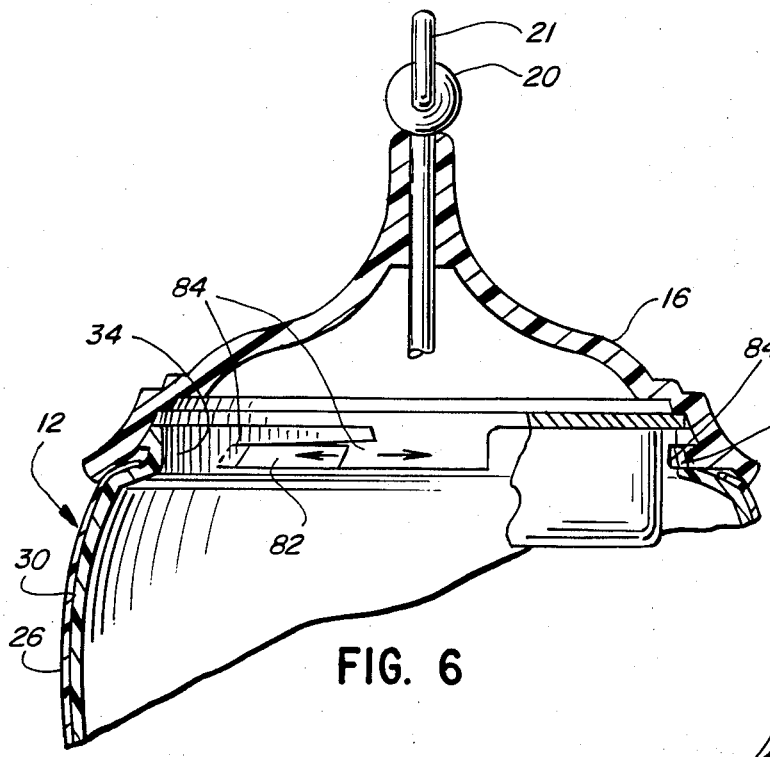
FIGS. 6 and 7 show alternate constructions for the mating of the parts shown in FIGS. 1–4.
Figure 7:
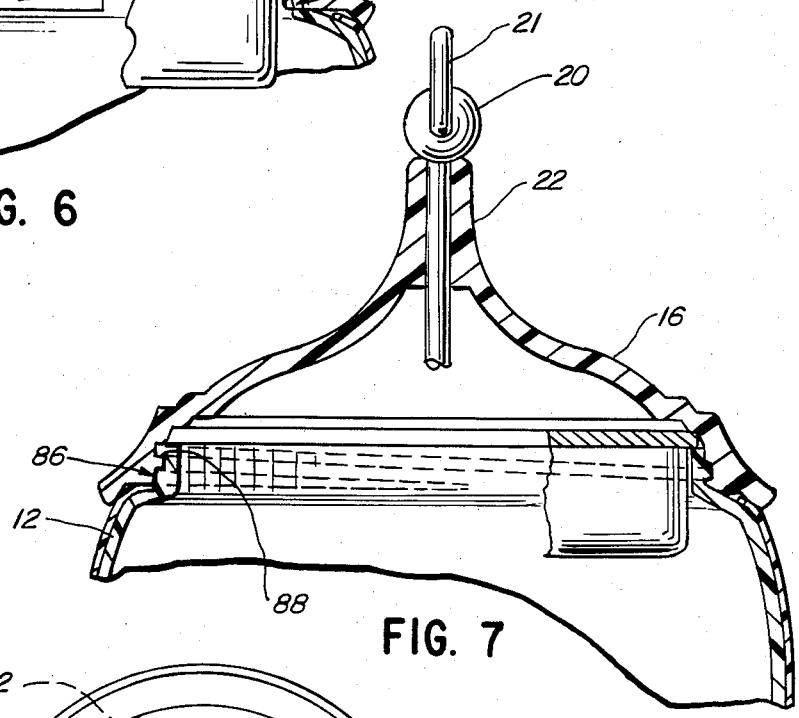

To further facilitate the use of the ornament as a gift box, alternate forms of securing the top end cap 16 to the main body 12 are provided, as shown in FIGS. 6 and 7. The method depicted in FIG. 6 includes the provision of bayonet-type intermateable retention elements including lugs 82 molded into the mating surface of the end cap and corresponding slots or receptacles 84 molded into the lip 34 of the main body element 12. These elements are provided in lieu of the snap fit elements shown in the prior embodiment. They mate with each other in the well-known twist-lock manner. In other words, the cap 16 is placed on the main body 12 with the lugs 82 in the open end of the slots 84. The cap is thereafter twisted until the lugs 82 are secured within the vertically closed ends of the slots 84. The latching elements in each part 12 and 16 are preferably provided in the molding process for the part. The relative locations of the lugs 82 and slots 84 may be reversed.

FIG. 7 depicts the use of threads 86, 88 molded into the mating surfaces of the main body 12 and end cap 16, respectively, to allow the end cap 16 to be secured, or removed, as the case may be, from the main body 12 by relative rotary motion of the two elements.

From the foregoing it should be apparent that the ornament construction of the present invention is adaptable to a wide variety of different ornamental as well as physical configurations. The two or three piece ornament construction disclosed herein is capable of not only housing the mechanical musical mechanism shown, but also an electrical lighting device can effectively utilize the capability of thin wall plastic to transmit light. The use of the lightweight injection molded plastic components of the present invention allows such alternate components to be used without creating an ornamental mechanism which is too heavy to be suspended from a Christmas tree or the like.

What is claimed is:

1. In combination: a suspendable ornament having an engageable hook receptacle at the top thereof for suspension of said ornament form above and a spring-driven music generator within said ornament, said hook receptacle being mounted for rotary motion relative to the top of said ornament and being coupled to said music generator to provide for winding and unwinding thereof, the unwinding of said music generator causing rotation of said ornament around its vertical axis, said ornament comprising a substantially hollow main body element with an upwardly extending opening and a separate top element adapted to cover said opening by snap engagement therewith, said music generator being enclosed and secured by the engagement of said main body element by said top element and being mounted on a horizontally disposed surface secured at its periphery between the main body and top elements of said ornament, and a shaft extending vertically from said music generator through the center of said top element to provide for manual winding of said music generator from the outside of said ornament, said main body element having a flange area formed around the lower end thereof, and said combination further comprising a decorative bottom element with means for engaging said flange area to secure the bottom element to the main body, said engaging means being releaseable to allow separation of the bottom element from the main body and the lower end of said main body being substantially flat to allow said ornament to stand on its own.

2. A suspendable ornament comprising:

a substantially hollow body of a thin flexible molded plastic material, said body having a flange around an upper rim portion formed to provide a downwardly facing annular surface and having a flange around a lower rim portion formed to provide an upwardly facing annular surface;

a top end cap having an extended annular apron portion in surrounding overlapping relation to said upper rim portion of said body, said top end cap having a discontinuous inwardly directed flange within said extended apron portion defining upwardly facing surfaces for locking engagement with angularly spaced portions of said downwardly facing surface of said upper rim portion flange, said discontinuous flange including three short sectors to facilitate flexing of portions of said top end cap which are located between said sectors to facilitate assembly and secure holding of said top end cap to said body while accommodating manufacturing tolerances, said top end cap having a central opening therethrough;

a bottom end cap having an extended annular apron portion in surrounding overlapping relation to said lower rim portion, said bottom end cap having a discontinuous flange within said extended apron portion defining downwardly facing surfaces for locking engagement with angularly spaced portions of said upwardly facing surface of said lower rim portion flange, said discontinuous flange of said bottom end cap including three short sectors to facilitate flexing of portions of said bottom end cap which are located between said sectors of said flange of said bottom end cap to facilitate assembly and secure holding of said bottom end cap while accommodating manufacturing tolerances;

a decorative outer film in shrunken tight engagement with the other surface of said body with upper and lower edge portions of said film being disposed within said apron portions of said top and bottom end caps;

a support board having a peripheral edge portion sandwiched between said upper rim portion of said body and a downward facing portion of said top end cap within said extended apron portion;

a spring driven music generator mounted on said support board, said music generator having a winding element;

a shaft coupled at its lower end to said winding element, said shaft extending through said top end cap central opening and having an engageable hook receptacle at the top thereof; and the height of said hollow body being such in relation to any downward extend of said music generator below said board as to provide a space of substantial size within said ornament for receiving a gift object or the like, said top end cap being disengageable from and reengageable with said hollow body for insertion or removal of said gift object and for use of said ornament as a musical ornament after removal of said gift object.

* * * * *